United States Patent [19]

Bostick

[11] Patent Number: 5,024,270

[45] Date of Patent: Jun. 18, 1991

[54] WELL SEALING DEVICE

[76] Inventor: John Bostick, Rte. 5, Box 307, Victoria, Tex. 77901

[21] Appl. No.: 412,655

[22] Filed: Sep. 26, 1989

[51] Int. Cl.[5] ..... E21B 23/04; E21B 23/06; E21B 33/129

[52] U.S. Cl. ..... 166/63; 160/120; 160/123; 160/134; 160/135

[58] Field of Search ..... 166/63, 120, 122, 134, 166/135, 182, 192, 212, 123

[56] References Cited

U.S. PATENT DOCUMENTS

| | | | |
|---|---|---|---|
| 2,189,937 | 2/1940 | Broyles | 166/63 |
| 2,621,744 | 12/1952 | Toelke | 166/63 |
| 2,651,371 | 9/1953 | Toelke . | |
| 2,656,891 | 10/1953 | Toelke . | |
| 2,807,325 | 9/1957 | Webb | 166/63 |
| 3,000,443 | 9/1961 | Thompson | 166/135 |
| 3,002,559 | 10/1961 | Hanes | 166/63 |
| 3,029,873 | 4/1962 | Hanes | 166/63 |
| 3,055,430 | 9/1962 | Campbell | 166/63 |
| 3,062,295 | 11/1962 | Hanes | 166/204 |
| 3,266,575 | 8/1966 | Owen | 166/63 |
| 3,374,838 | 3/1968 | Current | 166/123 |

*Primary Examiner*—Hoang C. Dang

*Attorney, Agent, or Firm*—Pravel, Gambrell, Hewitt, Kimball & Krieger

[57] ABSTRACT

A well sealing device using an internal propellant charge to drive slip segments outwardly against a well casing. A pin shears, releasing the device from its wire line prior to final setting of the slip segments.

6 Claims, 5 Drawing Sheets

WELL SEALING DEVICE

FIELD OF THE INVENTION

This invention is in the field of devices used for plugging a well casing at a desired depth.

BACKGROUND OF THE INVENTION

In the development or production of gas or oil wells it frequently becomes necessary to seal or plug the well casing at a desired depth. This sealing or plugging forms a barrier in the well bore to isolate upper and lower sections of the bore from each other. After the plugging has taken place, a pressure differential across the plug can exist and can vary from a few pounds per square inch to several thousand pounds per square inch. It is common for such plugs or sealing devices to be run into the well bore or casing on a wireline and then expanded or locked into place by means of generating a high pressure gas within the plug, or by generating a high pressure gas in a tool used to stroke the plug. Generation of the high pressure gas can be typically by the burning of a propellant, either in the plug itself or in a separate, but attached, firing chamber.

Currently known sealing devices typically use a series of concentric cylinders or chambers which move axially relative to one another to drive slip segments outwardly against the well casing. A feature commonly found in such devices is an element such as a shear pin which can shear to release the sealing device from the wireline after sealing has taken place. It is typical among such known devices to either shear the shear pin by jerking upwardly on the wireline after setting the sealing device or to shear the shear pin after setting of the sealing device by means of upsetting the shear pin structure through continued expansion of the propellant gas after setting of the sealing device is accomplished. Regardless of which of these two methods is used, it is a common occurrence to have a bridging plug or sealing device which does not set and seal tightly against the well casing and in which the shear pin has failed to shear, leaving the partially set sealing device attached to the wireline. It can then be very difficult to retrieve the wireline or the sealing device from the casing, and such removal can involve considerable expense to the operator.

It would be desirable to design a well sealing device which insures positive release from the wireline and which at the same time insures positive sealing against the well casing.

SUMMARY OF THE INVENTION

The present invention is a well sealing device which uses an internal propellant charge to seal the device positively against the well casing by the outward movement of several slip segments. This expansion of the slip segments is accomplished through a simplified combination of mandrel and wedge elements which, because of their simple structure, are not as susceptible to failure, resulting in incomplete sealing, as are the devices found in the prior art. In addition, the present invention provides for a positive release from the wire line as a first step in the setting of the sealing device against the casing. This insures that the wire line will be released from the device, thereby eliminating the need to run additional tools into the hole to retrieve a wire line from a sealing device which has been set into the casing.

DETAILED DESCRIPTION OF THE INVENTION

Figure 1A:
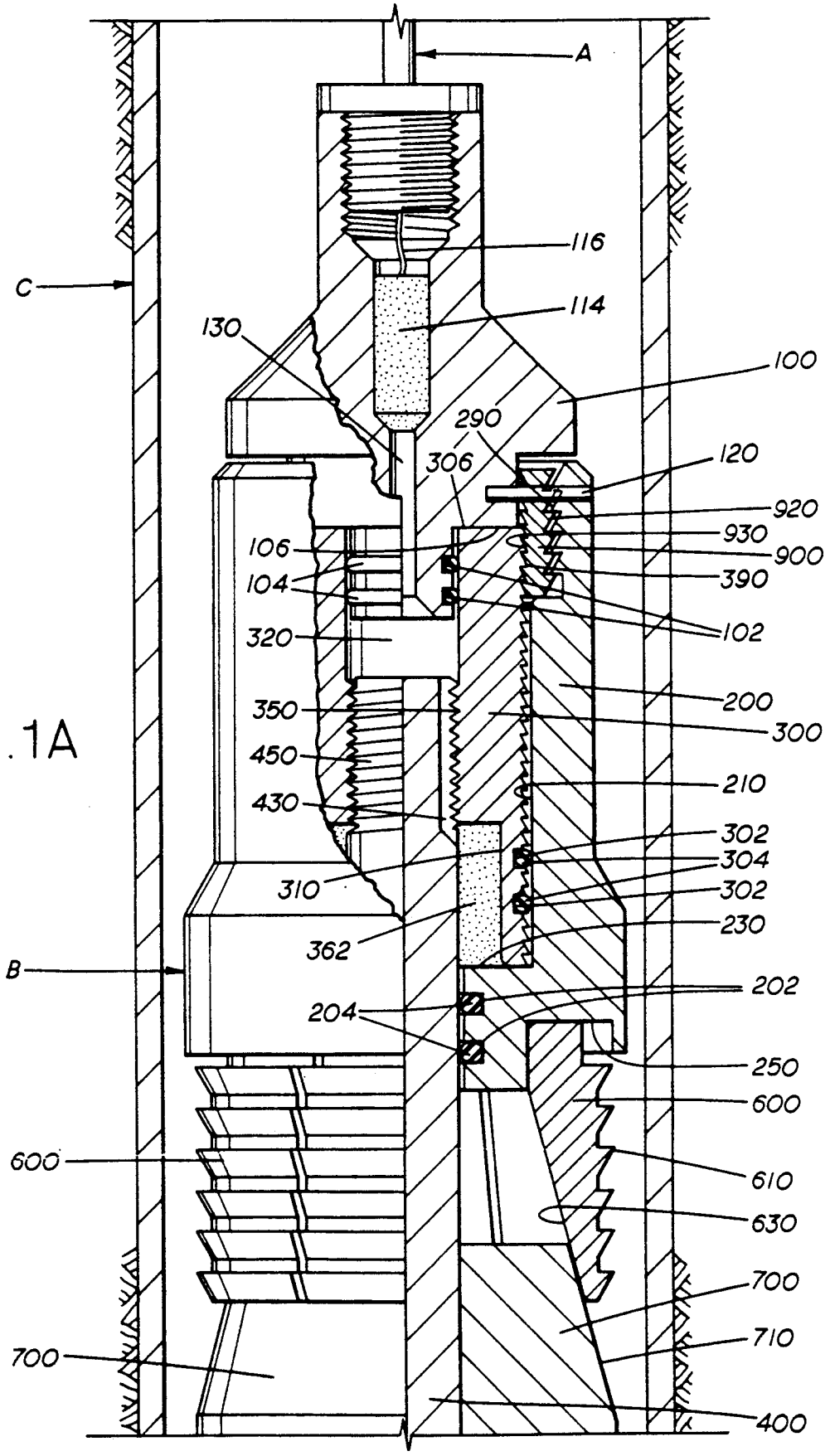
FIG. 1A is a sectional view of the upper portion of a well sealing device of the present invention prior to setting in the well casing.
Figure 1B:
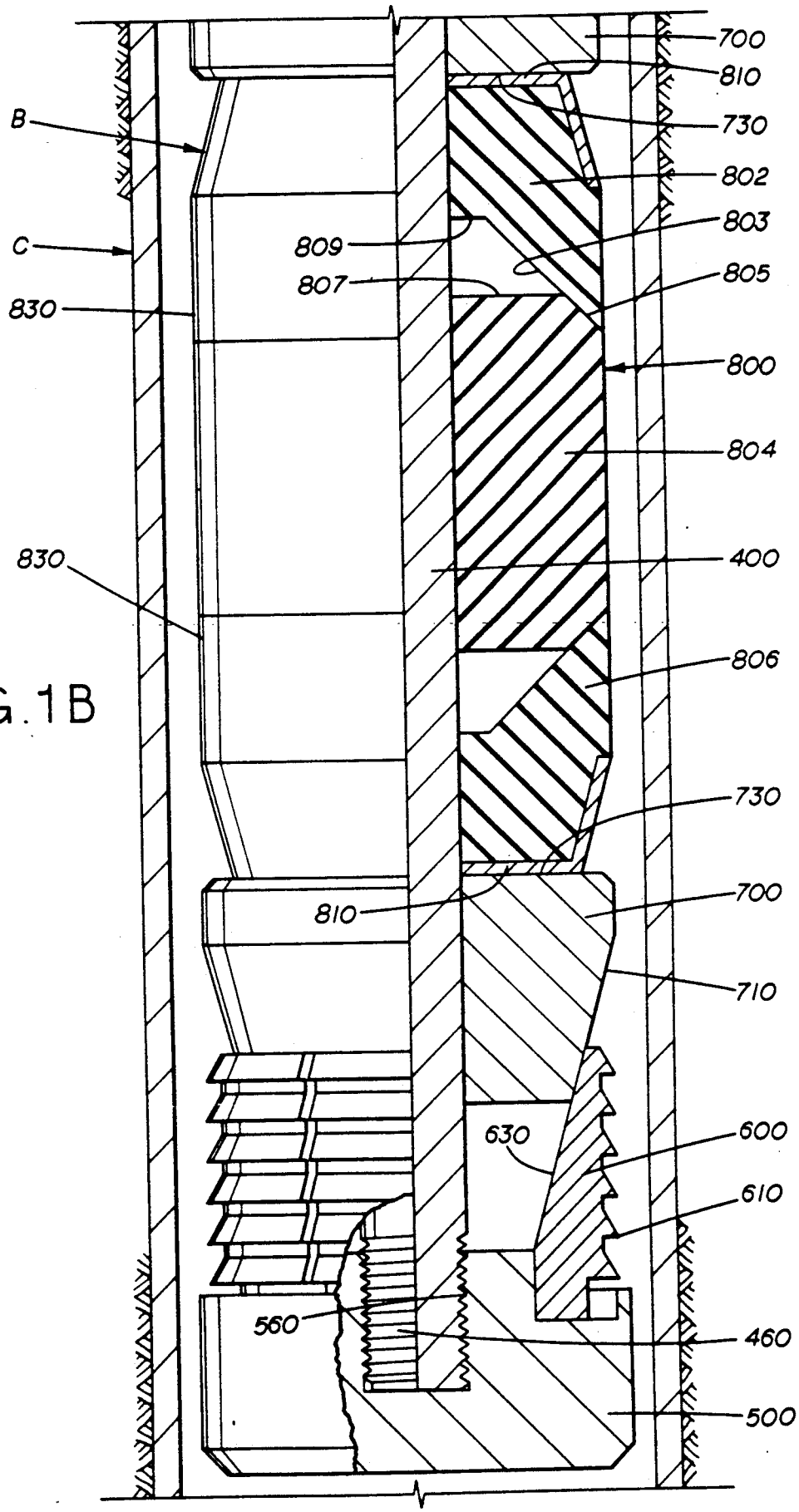
FIG. 1B is a sectional view of the lower portion of the device of FIG. 1A.
Figure 2:
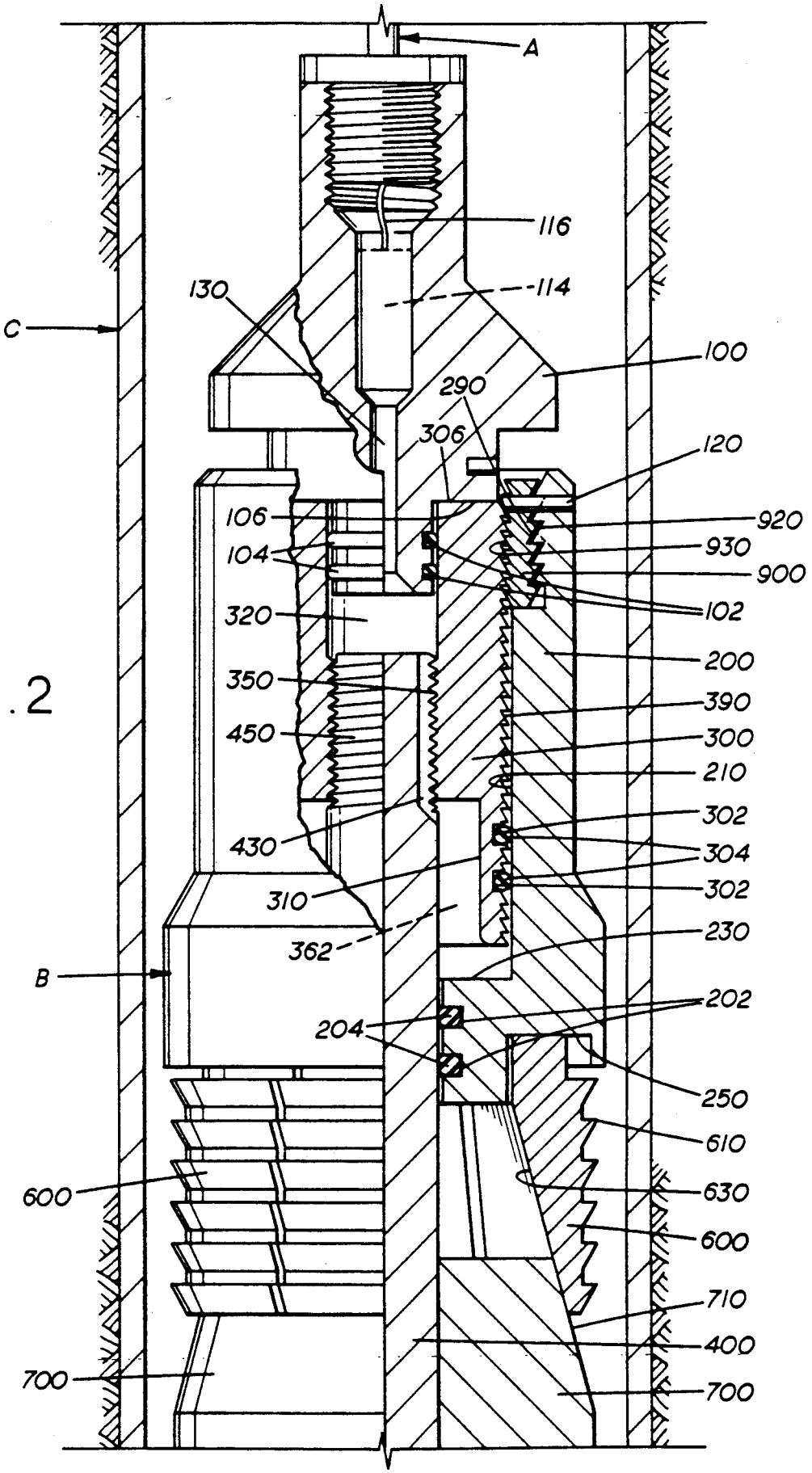
FIG. 2 is a sectional view of the device of FIG. 1A after release of the wire line and prior to setting of the device against the well casing.
Figure 3A:
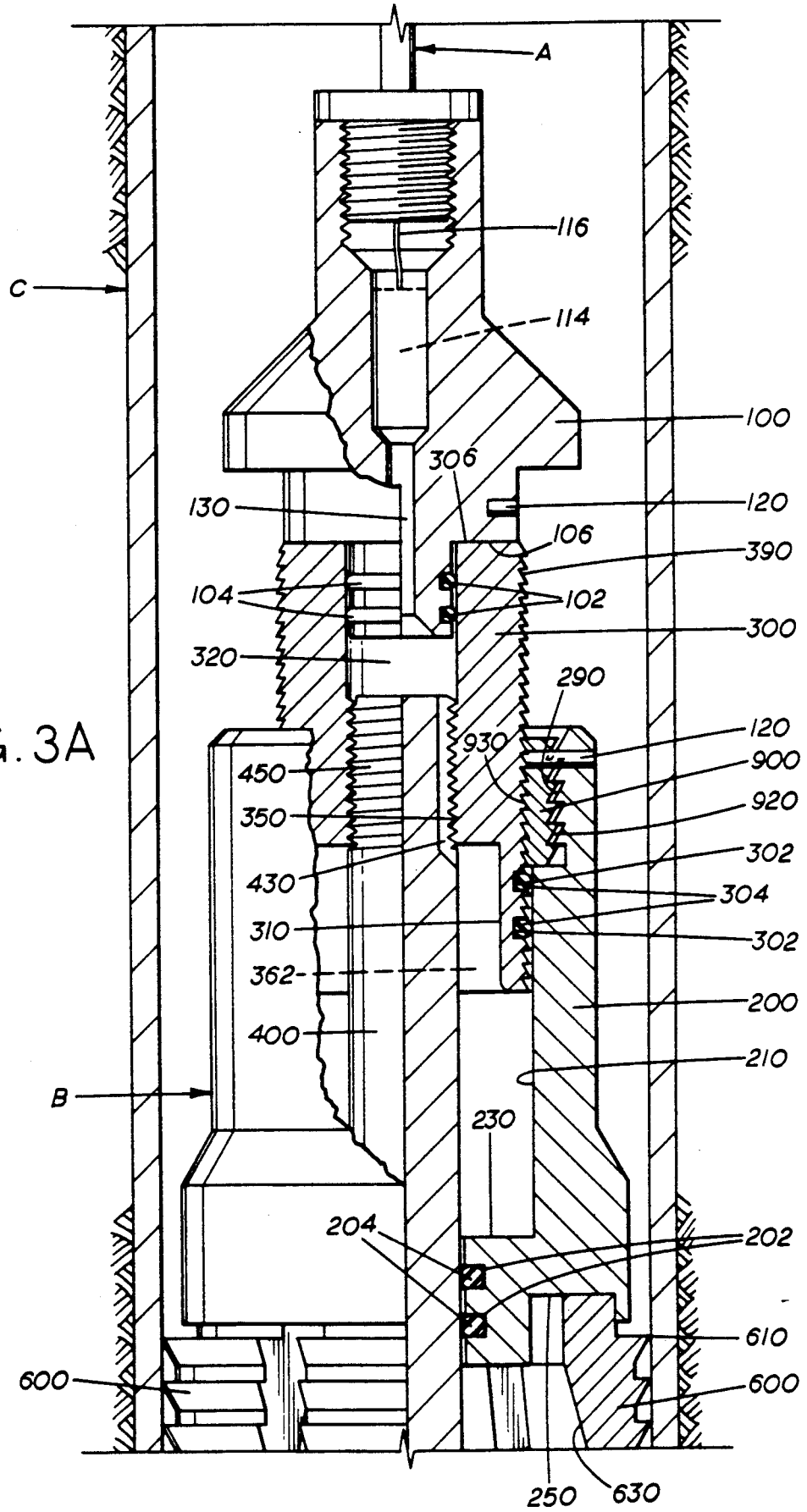
FIG. 3A is a sectional view of the device of FIG. 1A after setting of the device against the well casing.
Figure 3B:
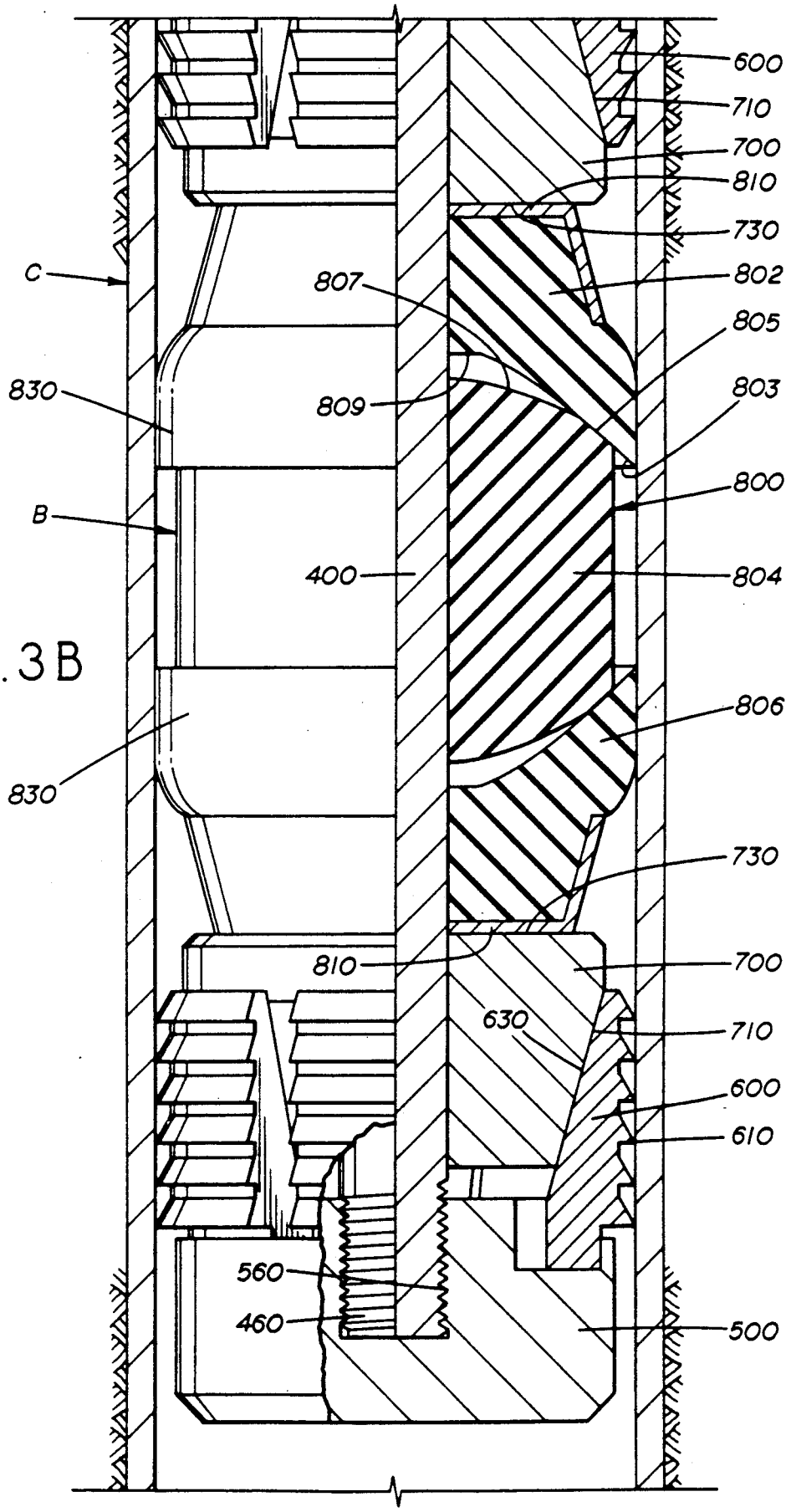
FIG. 3B is a sectional view of the device of FIG. 1B after setting of the device against the well casing.

As seen in FIGS. 1A and 1B, wire line A is attached to the top of the well sealing device B by being preferably threadedly attached to cable head 100. Cable head 100 is attached to upper housing 200 by means of shear pin 120. More than one such shear pin 120 can be used, and it will typically be a solid brass pin.

Cable head 100 extends downwardly into the upper end of pressure cylinder 300 in a relatively close sliding fit with the walls of ignition chamber 320 in pressure cylinder 300. The lower end of cable head 100 has circumferential sealing grooves 102 in which conventional rubber seals 104 can be used. The upper end 306 of cylinder 300 abuts shoulder 106 on cable head 100. The lower end of pressure cylinder 300 contains setting pressure chamber 310 which is connected to ignition chamber 320 by means of channel 430 in mandrel 400. A conventional ignitor 114 can be housed in cable head 100 connected to an electric lead 116 run with wire line A by known means. Leading from the ignitor 114 is primary ignition channel 130 which communicates with setting pressure chamber 310 by way of ignition chamber 320 and channel 430. Propellant 362, preferably gun powder or equivalent gas producing material, fills setting pressure chamber 310. The outer surface of pressure cylinder 300 has downwardly angled ratchet threads 390 which mesh with upwardly angled ratchet threads 930 in the inner surface of ratchet ring 900. Ratchet threads 390 and 930 are left hand threads in order to insure continued tightening of the plug during drilling if it becomes necessary to drill the plug out. Ratchet ring 900 is slotted to allow the passage of shear pin 120.

Pressure cylinder 300 is slidably mounted within pressure chamber 210 of upper housing 200. The upper end of the inner surface of upper housing 200 has downwardly angled threads 290 which mesh with upwardly angled threads 920 on the outer surface of ratchet ring 900. Threads 290 and 920 are also left hand threads.

Mandrel 400 is threaded into pressure cylinder 300 by means of threads 350 and 450. Mandrel 400 extends downwardly through the lower end of upper housing 200 in a slidable fashion. The lower end of upper housing 200 is sealed against mandrel 400 by internal circumferential grooves 202 which can contain known rubber seals 204.

The lower end of mandrel 400 is fixedly attached to lower housing 500 by means of being threaded directly into lower housing 500 by means of threads 460 and 560.

Slidably mounted along mandrel 400 between upper housing 200 and lower housing 500 are slip segments 600 held in place by conventional means, spreader elements 700 and sealing member 800. The lower end of upper housing 200 has slip drive surface 250 which bears downwardly against the upper end of upper slip segment 600. On the inner surface of slip segments 600 are frusto-conical surfaces 630 and on the outer surface are slip teeth 610 which face upwardly on upper segments 600 and which face downwardly on lower segments 600. Immediately below upper slip segment 600 and immediately above lower slip segment 600 are spreader elements 700 which have outwardly facing frusto-conical surfaces 710 which mate with inwardly facing frusto-conical surfaces 630 on the slip segments 600. Spreader elements 700 also have flat surfaces 730 which mate with flat surfaces 810 on sealing member 800. Sealing member 800 is a resilient three piece sealing member such as rubber or neoprene which slidably engages mandrel 400 in its inner bore and which is designed to expand until its outer surfaces 830 seal against the well casing C. Upper element 802 has inner frusto-conical surface 803 which mates with outer frusto-conical surface 805 on center element 804, leaving a concealed gap between upper end 807 of center element 804 and inner face 809 of upper element 802. Similarly, lower element 806 and center element 804 have a concealed gap therebetween and similar matching frusto-conical surfaces.

The operation of well sealing device B will now be described.

Well sealing device B is lowered into casing C to the desired point by means of wire line A. An electrical signal from the surface causes the ignitor 114 to ignite propellant 362 which initially drives pressure cylinder 300 upwardly, pushing cable head 100 upwardly, relative to upper housing 200, shearing shear pin 120 between cable head 100 and ratchet ring 900. Continued expansion sets the slip segments 600 immediately thereafter. Propellant 362 burns, generating an expanding gas causing upper housing 200 to be driven downwardly relative to pressure cylinder 300 because of the opposing pressures exerted on pressure cylinder 300 and reaction surface 230 at the lower end of pressure chamber 210. Mandrel 400 is attached in a rigid fashion to lower housing 500, so as upper housing 200 is driven downwardly, the slip segments 600 and sealing member 800 between upper housing 200 and lower housing 500 are subjected to a vertical compressive force.

Upper housing 200 presses downwardly on upper slip segments 600 which are driven outwardly by upper spreader element 700 and at the same time lower slip segments 600 are driven outwardly by lower spreader element 700 as upper and lower spreader elements 700 are driven toward each other by the compressive force. As the spreader elements 700 are driven toward each other, they also compress sealing element 800, causing center element 804 to expand upper and lower elements 802 and 806 outwardly until outer surfaces 830 of upper element 802 and lower element 806 contact well casing C.

As upper housing 200 is driven downwardly relative to pressure cylinder 300, ratchet threads 390 and 930 maintain the final relative axial position of upper housing 200 and pressure cylinder 300. This prevents any subsequent slackening of the compressive force on slip segments 600 and sealing member 800. Spreader elements 700 are tapered at a shallow angle so as to allow cylinder 300 to move sufficiently to shear the shear pin 120 before slip segments 600 contact securely with well casing C. Therefore, wire line A is positively released from the well sealing device B by the early expansion of propellant 362 which causes the upward movement of cable head 100 relative to housing 200. Wire line A can then be removed from the well bore.

Any subsequent pressure differential across the well sealing device B will result in a pressure being exerted from the high pressure side against sealing member 800 which will in turn press against spreader element 700 on the low pressure side of the seal, which will, in turn, exert further pressure on slip segments 600 on the low pressure side, insuring that slip segment teeth 610 maintain their engagement with well casing C. Increased pressure differential will result in increased sealing pressure at sealing member 800 and increased holding pressure at slip segment teeth 610.

The description given here is intended to illustrate the preferred embodiment of this invention. One skilled in the art will be able to devise variations on this invention which will be essentially equivalent to this embodiment. To the extent that any variations are equivalent, it is intended that they be encompassed by the following claims.

I claim:

1. A well sealing device comprising:

a cable head for attachment to a wire line;

an upper housing releasably attached to the cable head;

a pressure cylinder slidably mounted within the upper housing;

pressurizing means for creating an increased pressure within the pressure cylinder to cause the pressure cylinder to move relative to the upper housing and to cause the cable head to move relative to the upper housing;

a longitudinal mandrel attached at its upper end to the pressure cylinder;

a lower housing attached to the lower end of the mandrel;

expandable slip means slidably mounted on the mandrel between the upper housing and the lower housing for outward expansion upon vertical compression to set the slip means against a well casing; and a releasing means connected to the cable head and the upper housing for releasably attaching the cable head to the upper housing, the releasing means responsive to the relative movement between the upper housing and the cable head developed as a result of the pressurizing means causing movement of the pressure cylinder to release the cable head from the upper housing prior to partial setting of the slip means also developed as a result of the pressurizing means causing movement of the pressure cylinder and as a result the mandrel.

2. The well sealing device of claim 1, wherein;

the pressure cylinder and the mandrel move upwardly relative to the upper housing when pressure is increased within the pressure cylinder.

3. The well sealing device of claim 1, wherein the pressurizing means is a gas-producing combustible material between the pressure cylinder and the upper housing.

4. The well sealing device of claim 1, wherein the releasing means is a shear pin designed to release the cable head from the upper housing prior to setting the device against the well casing.

5. The well sealing device of claim 1, wherein the expandable slip means comprises:

a plurality of slip segments slidably mounted around the mandrel; and spreader means for expanding the slip segments outwardly upon vertical compression.

6. The well sealing device of claim 5, further comprising a resilient sealing member slidably mounted on the mandrel so as to be expanded outwardly away from the mandrel by the spreader means to effect a seal between the well bore and the mandrel.

* * * * *